US009315884B2

(12) United States Patent
Aljerf et al.

(10) Patent No.: US 9,315,884 B2
(45) **Date of Patent: *Apr. 19, 2016**

(54) WATCH-MAKING OR CLOCK-MAKING COMPONENT COMPRISING AN AMORPHOUS METAL ALLOY

(71) Applicant: ROLEX S.A., Geneva (CH)

(72) Inventors: Moustafa Aljerf, Saint Martin d'Heres (FR); Konstantinos Georgarakis, La Tronche (FR); Thomas Gyger, Le Fuet (CH); Alain Le Moulec, Gieres (FR); Vincent von Niederhäusern, Courrendlin (CH); Alain Yavari, La Tronche (FR)

(73) Assignee: ROLEX SA, Geneva (CH)

( * ) Notice: Subject to any disclaimer, the term of this patent is extended or adjusted under 35 U.S.C. 154(b) by 360 days.

This patent is subject to a terminal disclaimer.

(21) Appl. No.: 13/747,084

(22) Filed: Jan. 22, 2013

(65) Prior Publication Data

US 2013/0133788 A1 May 30, 2013

Related U.S. Application Data

(63) Continuation-in-part of application No. PCT/IB2011/001645, filed on Jul. 12, 2011.

(30) Foreign Application Priority Data

Jul. 21, 2010 (EP) ..... 10356023
Jun. 15, 2011 (CH) ..... 1009/11

(51) Int. Cl.

| | |
|---|---|
| ***C22C 45/02*** | (2006.01) |
| ***C22C 45/04*** | (2006.01) |
| ***C22C 1/00*** | (2006.01) |
| ***C22C 19/07*** | (2006.01) |
| ***C22C 33/00*** | (2006.01) |
| ***C22C 38/08*** | (2006.01) |
| ***C22C 45/00*** | (2006.01) |
| ***G04B 1/14*** | (2006.01) |
| ***C21D 9/00*** | (2006.01) |
| ***C22F 1/10*** | (2006.01) |

(52) U.S. Cl.

CPC ..... *C22C 45/02* (2013.01); *C21D 9/0068* (2013.01); *C22C 1/002* (2013.01); *C22C 19/07* (2013.01); *C22C 33/003* (2013.01); *C22C 38/08* (2013.01); *C22C 45/00* (2013.01); *C22C 45/008* (2013.01); *C22C 45/04* (2013.01); *C22F 1/10* (2013.01); *G04B 1/145* (2013.01)

(58) Field of Classification Search

None

See application file for complete search history.

(56) References Cited

U.S. PATENT DOCUMENTS

| | | | | |
|---|---|---|---|---|
| 4,365,994 | A | 12/1982 | Ray | |
| 4,755,239 | A | 7/1988 | O'Handley | |
| 6,843,594 | B1 | 1/2005 | Moteki et al. | |
| 2003/0150528 | A1 | 8/2003 | Martis et al. | |
| 2007/0144618 | A1* | 6/2007 | Adar | 148/304 |
| 2009/0303842 | A1 | 12/2009 | Gritti et al. | |
| 2012/0281510 | A1 | 11/2012 | Gyger et al. | |
| 2013/0126054 | A1* | 5/2013 | Aljerf et al. | 148/540 |

FOREIGN PATENT DOCUMENTS

| | | | |
|---|---|---|---|
| EP | 0 018 096 | A1 | 10/1980 |
| EP | 0 072 893 | A1 | 3/1983 |
| EP | 0 942 337 | A1 | 9/1999 |
| FR | 1108101 | A | 1/1956 |
| JP | 57-108237 | A | 7/1982 |
| JP | 4-124246 | A | 4/1992 |
| JP | 2001-279387 | A | 10/2001 |
| WO | 01/31085 | A2 | 5/2001 |
| WO | 2008/125281 | A1 | 10/2008 |
| WO | 2010/000081 | A1 | 1/2010 |
| WO | 2011/069273 | A1 | 6/2011 |
| WO | 2012/010940 | A2 | 1/2012 |
| WO | 2012/010940 | A3 | 1/2012 |

OTHER PUBLICATIONS

International Search Report for PCT/IB2011/001645, mailing date of Oct. 7, 2011.

T. Zhang and A. Inoue, "A New Method for Producing Amorphous Alloy Wires", Materials Transactions, JIM, vol. 41, No. 11, pp. 1463-1466, (2000).

X.J. Gu and S.J. Poon, "Mechanical properties of iron-based bulk metallic glasses", J. Mater. Res., vol. 22, No. 2, pp. 344-351, (2007).

K. Hajlaoui et al., "Shear delocalization and crack blunting of a metallic glass containing nanoparticles: In situ deformation in TEM analysis", Scripta Materialia 54, pp. 1829-1834, (2006).

A.O. Olofinjana, "Effects of process variables on the multi-strand casting of high strength sub-millimetre metallic glass wire", Journal of Materials Processing Technology 155-156, pp. 1344-1349, (2004).

Q. Wang et at., "Co- and Fe-based multicomponent bulk metallic glasses designed by cluster line and minor alloying", J. Mater. Res. vol. 23, No. 6, pp. 1543-1550, Jun. 2008.

A. R. Yavari et al., "On the nature of the remaining amorphous matrix after nanocrystallization of Fe77Si14B9 with Cu and Nb addition", Materials Science and Engineering, A181/A182, pp. 1415-1418, (1994).

* cited by examiner

*Primary Examiner* — George Wyszomierski

(74) *Attorney, Agent, or Firm* — Westerman, Hattori, Daniels & Adrian, LLP

(57) ABSTRACT

The invention relates to a watch-making or clock-making component comprising an amorphous metal alloy corresponding to the formula: $Fe_aCo_bNi_cNb_dV_eB_fTa_g$, in which: $0<a<70$; $0<b<70$; $8<c<60$; $1<d<19$; $1<e<10$; $12<f<25$; $0<g<5$; with $20<a+b<70$; $50<a+b+c<90$; $5<d+e<20$; and $a+b+c+d+e+f+g=100$. This watch-making or clock-making component may be a spring, such as a barrel spring.

22 Claims, No Drawings

WATCH-MAKING OR CLOCK-MAKING COMPONENT COMPRISING AN AMORPHOUS METAL ALLOY

This application is a continuation-in-part of PCT/IB2011/001645 filed Jul. 12, 2011, and claims priority of European application No. 10356023.1 filed Jul. 21, 2010 and Swiss application No. 01009/11 filed Jun. 15, 2011, each of which is hereby incorporated by reference in its entirety herein. The invention relates to a watch-making or clock-making component comprising an amorphous metal alloy. It can in particular be a spring, such as a barrel spring.

BACKGROUND OF THE INVENTION

A particular feature of the amorphous metal alloys, also called metallic glasses, is that they do not have long-range atomic order. They are of considerable interest for mechanical applications as they can have a high breaking stress and a wide range of elastic loading. In general, metallic glasses have a far higher breaking stress than crystalline alloys with equivalent Young's modulus.

These materials have a very high Ashby index $\sigma^2/E$, which positions them as materials of choice for making springs for energy storage. However, a study of the mechanical properties of metallic glasses shows that only metallic glasses based on Fe or Co would be capable of competing with the best known spring steels and alloys. Among these alloys, there are the Fe—Si or Fe—Co—Si or Fe—Si—B alloys used for their magnetic properties in the form of ribbons about thirty microns in thickness in the cores of inductors, as well as alloys intended for forming bulk metallic glasses, for example in [Gu et al., Mechanical properties of iron-based bulk metallic glasses, J. Mater. Res. 22, 258 (2007)]. It is also known that these alloys are brittle, either after shaping in the case of magnetic tapes, or intrinsically brittle in the case of bulk metallic glasses.

Now, mechanical application in clock and watch making, notably as a spring, requires tolerance to plastic deformation and/or fatigue strength, which implies a certain ductility of the material. Moreover, most of these alloys are magnetizable, which can cause disturbances of certain elements of a clock or watch movement, such as the oscillator.

Some scientific works mention the existence of plasticity for certain compositions of metallic glasses based on Fe or Co, for example $Fe_{59}Cr_6Mo_{14}C_{15}B_6$ disclosed in the work mentioned above.

European patent application EP 0018096 relates to powders consisting of ultrafine grains of transition metal alloy containing boron, notably at the rate of 5 to 12 at %. These powders are intended for the manufacture of cutting tools.

European patent application EP 0072893 relates to metallic glasses essentially consisting of 66 to 82 at % of iron, of which 1 to 8% can optionally be replaced with at least one element selected from nickel, cobalt and mixtures thereof, from 1 to 6 at % of at least one element selected from chromium, molybdenum, tungsten, vanadium, niobium, tantalum, titanium, zirconium and hafnium and from 17 to 28 at % of boron of which 0.5 to 6% can optionally replaced with silicon and 2% at most can be replaced with carbon. These metallic glasses are intended for tape recorder reading heads, cores of relays, transformers and similar equipment.

International patent application WO 2010/000081 describes the use of a ribbon consisting of an amorphous metal alloy of formula $Ni_{53}Nb_{20}Zr_8Ti_{10}Co_6Cu_3$ as barrel spring.

The Japanese patent application published under No. JP 4124246 relates to a dial, which is a watch-making or clock-making component without any mechanical function. This dial need not display ductility or high elastic resistance, in contrast to a component such as a barrel spring. Moreover, the amorphous alloy is not used as such, but is crystallized before use. The alloy contains Zr and/or Hf as a requirement, as well as Fe and B, and the examples refer to an FeZrCuB alloy.

The Japanese patent application published under No. JP 57108237 describes an amorphous alloy for a clock or watch spring, which is not, however, a high-performance spring like a barrel spring. A requirement of the alloy claimed is that it should contain Si, P or C. The description mentions the use of B but no information is given about the quantitative compositions, and addition of Ni or Fe is not mentioned. Finally, the examples relate to alloys comprising Cr and P.

The European patent application published under No. EP 0942337 relates to a watch-making or clock-making spring consisting of an amorphous metal such as Ni—Si—B, Ni—Si—Cr, Ni—B—Cr and Co—Fe—Cr.

Despite numerous tests on compositions known in the state of the art, for example $Fe_{59}Cr_6Mo_{14}C_{15}B_6$, the inventors were unable to obtain results usable for the intended applications in horology, owing to the brittleness of the material obtained in the form of ribbon. Therefore they searched for alloys specifically suited to the requirements of mechanical applications in horology.

For it to be able to be used in horology, an alloy must possess suitable mechanical properties (notably a very high breaking stress) and it must be possible for it to be cast or worked in the form of ribbon and to be shaped according to a very precise shape in order to maximize the energy stored by the spring.

More precisely, the inventors have defined specifications that an essentially amorphous metal alloy must satisfy in order to be used in a mechanical application in the field of horology, more particularly as a spring element, for example a simple spring such as a leaf spring, or an element obtained by cutting or stamping from a ribbon, or an element obtained by hot forming of a ribbon and/or by cold plastic deformation. Thus, the metal alloy must:

- allow the production of a metallic glass (amorphous alloy) with a thickness of 1 micron or more, in the form of ribbon produced for example by rapid solidification ("melt-spinning" or "planar flow casting"), or in the form of thin wire produced for example by water quenching (A. O. Olofinjana et al., J. of Materials Processing Tech. Vol. 155-156 (2004) pp. 1344-1349) or by disk quenching (T. Zhang and A. Inoue, Mater. Trans. JIM, Vol. 41 (2000) pp. 1463-1466);
- have high mechanical strength, preferably above 2400 MPa, or even above 3000 MPa.

For a mainspring or barrel spring, the metal alloy must moreover:

- be ductile in the form of a ribbon or wire as described above, i.e. does not break when stressed to 180° (diameter at break less than 1 mm when the ribbon or wire is folded on itself) and having a range of plastic deformation; and
- preferably have a capacity for annealing, i.e. preserve its intrinsic ductility and its mechanical properties after heat treatment for forming.

For a simple spring such as a leaf spring or for an element obtained by cutting or stamping from a ribbon, ductility and capacity for annealing are not essential. For a mainspring or barrel spring, ductility is essential and capacity for annealing is desirable to permit forming of the spring.

Moreover, it would be beneficial for the amorphous metal alloy to be paramagnetic in order to minimize the disturbances of the clock or watch movement in which it is integrated.

SUMMARY OF THE INVENTION

The invention relates to a watch-making or clock-making component comprising an amorphous metal alloy different from those mentioned above and satisfying the criteria defined in the aforementioned specification.

This amorphous metal alloy corresponds to the following general formula:

$$Fe_aCo_bNi_eNb_dV_eB_fTa_g$$

in which:

$0 \leq a \leq 70$;
$0 \leq b \leq 70$;
$8 < c \leq 60$;
$1 \leq d \leq 19$;
$1 \leq e \leq 10$;
$12 < f \leq 25$;
$0 \leq g \leq 5$;
with
$20 \leq a+b \leq 70$;
$50 \leq a+b+c \leq 90$;
$5 \leq d+e \leq 20$; and
$a+b+c+d+e+f+g=100$.
Preferably, $50 \leq a+b+c \leq 83$.

The invention also relates to a method of preparing the watch-making or clock-making compound according to the invention comprising the following steps:

a) pre-melting the pure metallic elements Fe and/or Co, Ni, Nb and V and possibly Ta in a container;
b) heating boron, so as to remove any gas molecules that it contains;
c) mixing the pre-melted metallic elements and the solid boron;
d) heating the mixture obtained;
e) cooling it;
f) optionally repeating steps d) and e) one or more times, the last step e) being a hyperquench, making it possible in particular to obtain the amorphous metal alloy in the form of wire or ribbon;
g) forming the alloy obtained to the desired shape for the watch-making or clock-making component.

Other features and advantages of the invention will now be described in detail in the following account.

DETAILED DESCRIPTION OF THE INVENTION

In the present description, "amorphous metal" means a substantially amorphous metal-based alloy, consisting predominantly of an amorphous phase, i.e. whose volume fraction of the amorphous phase or phase(s) in all of the material exceeds 50%.

According to the invention, to be able to meet the aforementioned specification, the amorphous metal alloy must correspond to the general formula mentioned above. The sum of the indices a to g being equal to 100 is equivalent to saying that it is a question of atomic percentages (at %).

According to a preferred embodiment of the invention, the indices a to g of the general formula satisfy the following conditions:

$0 \leq a \leq 60$;
$0 \leq b \leq 60$;
$10 \leq c \leq 50$;
$2 \leq d \leq 17$;
$2 \leq e \leq 8$;
$14 \leq f \leq 20$;
$0 \leq g \leq 4$;
with
$25 \leq a+b \leq 65$;
$60 \leq a+b+c \leq 80$; and
$8 \leq d+e \leq 17$.
More preferably, $50 \leq a+b+c \leq 78$.
Even more preferably:
$0 \leq a \leq 56$;
$0 \leq b \leq 54$;
$12 \leq c \leq 40$;
$4 \leq d \leq 14$;
$4 \leq e \leq 6$;
$15 \leq f \leq 17$;
$0 \leq g \leq 4$;
with
$30 \leq a+b \leq 60$;
$68 \leq a+b+c \leq 75$; and
$11 \leq d+e \leq 15$.

According to another advantageous embodiment of the invention, the amorphous metal alloy lacks iron, i.e. a=0. It can have the following preferred values:
$31 \leq b \leq 56$;
$13 \leq c \leq 41$;
$7 \leq d \leq 13$;
$4 \leq e \leq 10$; and
$13 \leq f \leq 17$.

If in addition g=0, the amorphous metal alloy then belongs to the system Co—Ni—Nb—V—B. It can have the following preferred values:
$31 \leq b \leq 56$;
$13 \leq c \leq 41$;
$7 \leq d \leq 13$;
$4 \leq e \leq 10$; and
$13 \leq f \leq 17$.
More advantageously, it can have the following values:
$31 \leq b \leq 51$;
$21 \leq c \leq 41$;
$7 \leq d \leq 9$;
$4 \leq e \leq 6$; and
$14 \leq f \leq 16$.
Even more advantageously, $d \approx 8$, the other values remaining in the same ranges.

According to another embodiment of the invention, the amorphous metal alloy lacks cobalt, i.e. b=0. If in addition g=0, the alloy then belongs to the system Fe—Ni—Nb—V—B. It can then have the following preferred values:
$47 \leq a \leq 57$;
$17 \leq c \leq 23$;
$3 \leq d \leq 9$;
$4 \leq e \leq 10$; and
$13 \leq f \leq 17$.
More advantageously, it can have the following values:
$49 \leq a \leq 57$;
$17 \leq c \leq 23$;
$5 \leq d \leq 7$;
$4 \leq e \leq 8$; and
$14 \leq f \leq 16$.
Even more advantageously, it can have the following values:
$51 \leq a \leq 57$;
$17 \leq c \leq 23$;
$5 \leq d \leq 7$;
$4 \leq e \leq 6$; and
$14 \leq f \leq 16$.

According to another embodiment of the invention, the amorphous metal alloy must contain iron and cobalt, i.e. a and b are both different from zero, and does not contain Ta, i.e. g=0.

It can then have the following preferred values:

$28 \leq a \leq 38$;

$18 \leq b \leq 26$;

$10 \leq c \leq 24$;

$7 \leq d \leq 9$;

$4 \leq e \leq 6$; and $14 \leq f \leq 16$.

Method of Preparation

The watch-making or clock-making component according to the invention comprising or consisting of the amorphous metal alloy as defined above can be prepared as follows:

a) pre-melting the pure metallic elements Fe (99.95%) and/or Co (99.95%), Ni (99.98%), Nb (99.99%) and V (99.8%) and possibly Ta in a container arranged in a furnace, for example an arc furnace of model MAM1 made by Edmund Bühler, under an inert atmosphere, for example argon, so as to remove any oxides contained in the metals;

b) heating boron in the almost pure state (99.5%) in a quartz crucible surrounded by a graphite crucible heated by induction to high temperature, for example 1200° C., and under partial vacuum, of the order of $10^{-6}$ mbar, in order to effect degassing, i.e. removal of any gas molecules, such as oxygen, nitrogen and oxides present in the boron;

c) putting the elements in a furnace, notably an arc furnace;

d) heating the whole, preferably for a time of less than 1 minute, under an inert atmosphere, for example argon, to a temperature well above the melting point of the alloy;

e) leaving to cool under an inert atmosphere;

f) repeating the cycle of steps d) and e) several times, so as to homogenize the alloy. To obtain an amorphous structure from the alloy produced, the last step e) of cooling after melting the alloy (step d) must be a hyperquench. Here, hyperquench means ultrafast quenching, i.e. cooling at a rate exceeding 1000 K/s, which makes it possible to vitrify the alloy. The alloy can then be cast in the form of ribbon or wire.

g) then forming the alloy obtained to the desired shape for the watch-making or clock-making component.

Any forming process or method can then be used. We may mention for example the method forming the object of the aforementioned international application WO2010/000081, or the method described below.

According to an advantageous embodiment of the invention, the hyperquench and casting of the alloy in the form of ribbon or wire are performed simultaneously, by discharging the molten alloy onto one or two rotating wheels, for example employing the method called "twin roll casting" (casting between two wheels), or better still, the method called PFC ("planar flow casting").

The PFC method consists essentially of heating the alloy by induction, in a boron nitride crucible, to a temperature 100° C. above its melting point, under helium partial pressure (typically 500 mbar). The alloy is then discharged through a nozzle onto a copper cooling wheel rotating at high speed. In this way a ribbon that is rectilinear and has an excellent surface condition is obtained directly.

According to another advantageous embodiment of the invention, step c) of the method is divided into substeps of formation of partial mixtures so as to form pre-alloys whose melting point Tm is well below that of the individual constituents.

For example, for the alloys of the system Fe—Ni—Nb—V—B (b=0 and g=0), which contain elements with a high melting point (Nb: 2469° C., V: 1910° C.), specimens of the two eutectic binary compositions $Ni_{58.5}Nb_{41.5}$ (Tm=1184° C.) and $Ni_{50}V_{50}$ (Tm=1220° C.) can be produced, then quantities corresponding to the percentages of V and Nb are mixed. In parallel, the quantities of Fe and B are melted together, then with the remaining quantity of Ni. Finally, the final alloy specimen is produced by melting the three pre-alloys (NiNb+NiV+FeB) and the balance of the pure elements.

The steps mentioned above and their sequence constitute a nonlimiting example for preparing the amorphous metal alloy. The method as described provides reliable and reproducible production, and also makes it possible to maximize the thickness limit for which the alloy remains ductile. An amorphous alloy can be produced omitting one or more steps, or modifying the conditions used, but generally to the detriment of the reliability of the method and the maximum thickness.

EXAMPLES

I) Experimental Techniques

1) Manufacture of Ribbons

Substantially amorphous metal alloys were prepared and then cast directly in the form of ribbons by PFC.

A target thickness of 65 μm is set, in order to compare the alloys with one another. In fact, the properties of the specimens, such as ductility, resistance to embrittlement on annealing, Young's elastic modulus and the glass transition temperature (Tg) depend on the cooling rate of the alloy, and therefore intrinsically on the thickness of the ribbon.

2) Measurements of Bending

The mechanical properties in bending are measured with a 2-point bending tester. In this method, the specimen in the form of ribbon is curved in a U-shape between two parallel planes. One of the planes moves and the other remains fixed. The apparatus simultaneously measures the distance between the planes and the force produced by the specimen, as described for example in international patent application WO 2008125281. The advantages of this method are that the maximum stress is concentrated in a place that is not submitted to contact, it does not cause sliding of the specimen at the two points of support, which thus makes it possible to induce stresses reliably and reproducibly, as well as large strains.

For each ribbon, three specimens with a length of 75 mm are tested in bending. Measurement starts with an initial spacing of 16 mm and is stopped at a final spacing of 2.3 mm with a speed of displacement of 0.2 mm/s. After this cycle of loading/unloading, the specimen is plastically deformed locally.

For all the alloys produced, it was verified that the elastic strain was close to 2%. The elastic modulus was therefore adopted as an indicator of the mechanical strength of the specimens.

As the cross section of the ribbons is not perfectly rectangular (trapezoidal shape directly after solidification), the modulus deduced from the measurements must be regarded as a quantity that is representative of the apparent bending stiffness, which makes it possible to compare the alloys with one another, and not as the true value of the Young's modulus of the material. Nevertheless, the values presented are corrected with a form factor to take best account of the true moment of inertia and are relatively close to the expected values of the Young's modulus for alloys of this type, as well as values deduced from tensile testing.

3) Calorimetric Measurements

The thermal properties of the metallic glasses or of the amorphous metal alloys (glass transition temperature Tg, crystallization temperature Tx) are measured by differential scanning calorimetry (DSC) on apparatus of the Setaram Setsys Evolution 1700 type, during a heating ramp at 20° C./min under an argon stream of quality 6 (20 ml/min). The measured specimen weight is from 30 to 50 mg. The pieces of ribbon are put in an alumina crucible.

4) X-Ray Diffraction Measurements

This technique is used for verifying the amorphous character of the ribbons obtained. The measurements were carried out on apparatus of the Xpert-PRO MPD type from Panalytical. If the signal measured does not have a diffraction peak, the alloy is considered to be amorphous (AM), rather than a crystalline alloy (CR). The limit of detection of a crystalline phase is generally located at 5% (volume fraction of the crystalline phase), and the depth probed during the measurement is typically 5 μm, or well below the typical thickness of the ribbon.

5) Measurements of Brittleness on Annealing

The use of ribbons of amorphous or substantially amorphous metal alloys as springs, notably in a clock or watch movement and more particularly as barrel springs, requires a step of forming of the ribbon. This forming can be performed hot and/or cold.

In the case of cold forming (and mechanical loading of the watch-making or clock-making component), the alloy must display ductile behavior. The ductile or brittle character of a ribbon is assessed by folding at 180°. It is considered to be ductile if, once folded on itself at 180°, it does not break into two parts. The ribbon is considered to be partially ductile if it breaks before reaching an angle of folding of 180°, but it shows an increase in plasticity at the place of the fold. This test makes it possible to assess whether the deformation at rupture occurs in the plastic range, and represents a very strict criterion which corresponds to several tens of percent of deformation in the surface fibers.

In the case of hot forming, it is important that the ribbon does not lose its initial ductile character following the annealing treatment. To verify that there is a treatment window (time/temperature) that permits forming without embrittlement, annealing operations were carried out on initially straight strips with a length of 30 mm coiled up inside aluminum rings with an inside diameter of 7.8 mm, either in a furnace, or by heating by a jet of hot gas.

Once the ribbon has cooled, the diameter of curvature of the relaxed strip is measured with a caliper gauge. The relaxed ribbon is then placed between the two flats of the caliper gauge as in a 2-point bending test and the distance apart at rupture is recorded while slowly bringing the two flats closer together. The fixing coefficient is calculated as the ratio of the inside diameter of the ring $D_0$ and the diameter of curvature of the relaxed strip $D_f$ (see international applications WO2010/000081 and WO2011/069273).

An alloy that is initially ductile will, during annealing at a given temperature (preferably, $0.8T_g<T<T_g$), become brittle after a given annealing time $t_0$. During this time $t_0$ that is available before embrittlement of the alloy, it is possible to reach a certain fixing coefficient.

Evaluation of the annealing resistance of the alloys is based essentially on these two criteria: maximize the time for embrittlement in annealing $t_0$ at a given temperature and maximize the fixing coefficient obtained at time $t_0$. In practice, it is considered that the capacity for annealing is good if there is a treatment time and a treatment temperature such that the ribbon remains ductile after heat treatment, with a degree of fixing>50%.

II) Tests

1) Fe—(Co)—Ni—Nb—V—B System

Table 1 below describes the various alloys produced with the elements Fe(Co)NiNbVB.

A specimen having a weight varying between 11.0 and 13.5 g was used for each test.

First, the nickel content was varied in a range from 18 to 22 at %, and the niobium content from 6 to 8 at %. The concentrations of vanadium and of boron were kept constant at 5 at % and 15 at % respectively.

Secondly, the ratio between the two refractory metals V and Nb was varied. A concentration of V of 9 at % leads to embrittlement of the alloy, according to the very strict criterion of the folding test at 180°.

In other tests (not shown in the table) that were carried out with a niobium concentration exceeding 10 at %, formation of an intermetallic with a high melting point is observed, which makes it difficult to produce ribbons by PFC.

The mechanical and thermal properties depend essentially on the concentration of Nb. The alloys with a concentration of Nb of 8 and 10 at % are brittle or quickly become brittle during the heat treatment for forming, according to the very strict criterion of the folding test at 180°. Good ductility after annealing is seen for the alloys having 6 at % of Nb, but at the expense of the (apparent) elastic modulus, which is lowered.

The alloys that are considered to be brittle following the folding test at 180° are not suitable for use as a high-performance spring, notably a mainspring or a barrel spring, but can certainly be used in applications with loading conditions that are less severe. Moreover, alloys that do not have adequate annealing resistance can still be perfectly usable in applications not requiring forming of the ribbon or wire, notably a hot forming step.

Certain compositions, for example the composition $Fe_{52}Ni_{22}Nb_6V_5B_{15}$, display quite remarkable properties, i.e. a high Young's modulus combined with good ductility at a thickness of at least 65 μm, even after heat treatment for forming.

The ribbons obtained have a thickness varying from 62 to 68 μm in 90% of cases, or very close to the target thickness of 65 μm. In most cases the critical thickness is not reached and ribbons of larger thickness can be produced. This limit can also be pushed back by increasing the cooling rate.

Table 1 also supplies an important finding: the great majority of ductile ribbons have a peak of a crystalline phase on the "free" side of the ribbon, i.e. the face in contact with the atmosphere, in contrast to the "wheel" face that was in contact with the copper wheel. This crystalline phase, indicated by AM/CR in the table, is formed of nanocrystals, whose size is estimated at 8-10 nm by measuring the width of the X-ray diffraction peaks, dispersed in the amorphous matrix. It is known that the presence of nanocrystals can, under certain conditions, favor the plasticity of metallic glasses [Hajlaoui et al., Shear delocalization and crack blunting of a metallic glass containing nanoparticles: In situ deformation in TEM analysis, Scripta materiala 54, 1829 (2006)]. However, no correlation is observed between the presence or absence of this phase and the ductility of the alloy.

X-ray diffraction measurements make it possible to estimate the total volume fraction. The intensity of the signal from the crystalline phase detected on the "free" side typically corresponds to 15% of the volume fraction of the depth probed, which is about 5 μm. As no crystalline phase is detected on the "wheel" side, the total volume fraction is much lower than this value, and probably well below 10%. It can therefore be stated that all the alloys produced are substantially amorphous. It should be noted that the exact value of the volume fraction for a given composition and a given thickness also depends on the conditions of production (casting temperature, surface condition of the wheel, alloy of the wheel, etc.), which are just as much parameters that influence the cooling rate.

It will also be noted that by partial replacement of Fe with Co, the alloy can absorb 8 at % of Nb without the ductility of the ribbon being compromised (in comparison with $Fe_{50}Ni_{22}Nb_8V_5B_{15}$).

2) Co—Ni—Nb—V—B System

The Co-based alloys investigated are listed in Table 2. In the Co—Ni—Nb—V—B system, it was possible to increase the Nb content beyond the ductile/brittle barrier of 6 at % of the Fe—Ni—Nb—V—B system, which makes it possible to obtain higher values of hardness and of elastic modulus. In contrast, this barrier is located at 8 at % for this system. The content of metalloid B is limited to 15 at %, and "minor alloying" with Ta makes it possible to preserve the ductility and hardness but lowers the value of elastic modulus slightly.

In this system, the elements based on cobalt and nickel play an essential role for the values of elastic modulus and annealing resistance. Cobalt advantageously replaces iron in all aspects but without nickel the alloy suffers an appreciable loss of hardness. The maximum apparent elastic modulus occurs at 167 GPa for the composition $Co_{50}Ni_{22}Nb_8V_5B_{15}$, but it is not possible to state that this is an optimum for this system. It can also be seen that a ductile strip of 86 μm was produced. The critical ductile/brittle thickness has not, however, been reached and is greater than 86 μm.

TABLE 1

| Alloys | Composition Fe a | Co b | Ni c | Nb d | V e | B f | Base a + b + c | Refr: d + e | Thickness [μm] | Structure (XRD) Free side | Wheel side | DSC Tg [° C.] | Tx [° C.] | Ductility (180° test) — | E [GPa] | Resistance to annealing |
|---|---|---|---|---|---|---|---|---|---|---|---|---|---|---|---|---|
| $Fe_{50}Ni_{22}Nb_8V_5B_{15}$ | 50 | — | 22 | 8 | 5 | 15 | 72 | 13 | 67 | AM | AM | 495 | 535 | partial | 157 | No |
| $Fe_{52}Ni_{20.66}Nb_{7.33}V_5B_{15}$ | 52 | — | 20.7 | 7.33 | 5 | 15 | 72.66 | 12.33 | 70 | AM/CR | AM | 485 | 514 | partial | 153 | No |
| $Fe_{56}Ni_{18}Nb_6V_5B_{15}$ | 56 | — | 18 | 6 | 5 | 15 | 74 | 11 | 67 | AM/CR | AM | 477 | 504 | ductile | 155 | Yes |
| $Fe_{54}Ni_{20}Nb_6V_5B_{15}$ | 54 | — | 20 | 6 | 5 | 15 | 74 | 11 | 69 | AM/CR | AM | 471 | 499 | ductile | 152 | No |
| $Fe_{52}Ni_{22}Nb_6V_5B_{15}$ | 52 | — | 22 | 6 | 5 | 15 | 74 | 11 | 66 | AM/CR | AM | 449 | 494 | ductile | 154 | Yes |
| $Fe_{48}Ni_{22}Nb_6V_9B_{15}$ | 48 | — | 22 | 6 | 9 | 15 | 70 | 15 | 63 | n.a. | n.a. | 474 | 512 | partial | 153 | No |
| $Fe_{52}Ni_{22}Nb_4V_7B_{15}$ | 52 | — | 22 | 4 | 7 | 15 | 74 | 11 | 67 | n.a. | n.a. | 448 | 487 | ductile | 139 | Yes |
| $Fe_{50}Ni_{22}Nb_6V_7B_{15}$ | 50 | — | 22 | 6 | 7 | 15 | 72 | 13 | 63 | AM | AM | 471 | 500 | ductile | 151 | Yes |
| $Fe_{30}Co_{20}Ni_{22}Nb_8V_5B_{15}$ | 30 | 20 | 22 | 8 | 5 | 15 | 72 | 13 | 66 | n.a. | n.a. | 473 | 510 | ductile | 150 | Yes |
| $Fe_{36}Co_{24}Ni_{12}Nb_8V_5B_{15}$ | 36 | 24 | 12 | 8 | 5 | 15 | 72 | 13 | 64 | n.a. | n.a. | 485 | 522 | ductile | 153 | Yes |

AM = completely amorphous
AM/CR = having a crystalline phase
n.a. = not available/measurement not carried out It can be seen that in nearly all cases, the elastic modulus E is above 150 GPa.

The role of the refractory elements in the alloys according to the invention corresponds to what is called "minor alloying", which has a driving effect in the formation of glass [Wang et al., Co- and Fe-based multicomponent bulk metallic glasses designed by cluster line and minor alloying, Journal of Materials Research 23, 1543 (2007)]. In the alloy system according to the invention, the role of the refractory elements (Nb, V) is not limited to promoting the formation of the glass, as they modify the mechanical properties such as hardness and ductility. In this context, the content of V was increased without that of Nb exceeding 6%. The results presented in Table 1 do not show a significant improvement of the various properties of the strip, except hardness (not shown), which is slightly increased.

The alloy $Fe_{52}Ni_{22}Nb_6V_5B_{15}$ is ferromagnetic with a Curie point of 453 K (180° C.), which is lower than the Curie point of the Fe—B amorphous binary alloys. This drop is attributed to the addition of elements of addition, especially of Nb, which is an element that is known to have this effect [Yavari et al., On the Nature of the Remaining Amorphous Matrix after Nanocrystallization of Fe77Si14B9 with Cu and Nb Addition, Materials Science and Engineering A182, 1415 (1994)].

It can be seen that in all cases, the elastic modulus E is above 150 GPa. The observations made above concerning the presence of a crystalline phase on the "free" side of the ribbons obtained in Fe-based alloys (Table 1) also apply to the Co-based alloys presented in Table 2.

Certain compositions, for example the composition $Co_{50}Ni_{22}Nb_8V_5B_{15}$, thus display quite remarkable properties, i.e. a high Young's modulus combined with good ductility at a thickness of at least 80 μm, even after heat treatment for forming. It appears that this is the first time that an amorphous metal alloy combining these various characteristics has been obtained.

The alloy $Co_{50}Ni_{22}Nb_8V_5B_{15}$ is clearly paramagnetic at room temperature, as saturation magnetization is not reached even with a magnetic field of 3 tesla. This paramagnetic behavior is added to the very desirable mechanical properties (elastic modulus and hardness) and the increased resistance to embrittlement.

TABLE 2

| Alloys | Composition Co b | Ni c | Nb d | V e | Ta g | B f | Base a + b + c | Refr d + e | Thickness [μm] | Structure (XRD) Free side | Wheel side | Ductility (180° test) — | E [GPa] | Resistance to annealing |
|---|---|---|---|---|---|---|---|---|---|---|---|---|---|---|
| $Co_{50}Ni_{18}Nb_{12}V_5B_{15}$ | 50 | 18 | 12 | 5 | | 15 | 68 | 17 | 63 | AM | AM | partial | 169 | No |
| $Co_{54}Ni_{14}Nb_{12}V_5B_{15}$ | 54 | 14 | 12 | 5 | | 15 | 68 | 17 | 63 | AM | AM | partial | 169 | No |
| $Co_{32}Ni_{40}Nb_8V_5B_{15}$ | 32 | 40 | 8 | 5 | | 15 | 72 | 13 | 65 | AM/CR | AM | ductile | 162 | Yes |
| $Co_{40}Ni_{32}Nb_8V_5B_{15}$ | 40 | 32 | 8 | 5 | | 15 | 72 | 13 | 68 | AM/CR | AM | ductile | 163 | Yes |
| $Co_{42}Ni_{30}Nb_8V_5B_{15}$ | 42 | 30 | 8 | 5 | | 15 | 72 | 13 | 66 | AM/CR | AM | ductile | 160 | Yes |
| $Co_{50}Ni_{22}Nb_8V_5B_{15}$ | 50 | 22 | 8 | 5 | | 15 | 72 | 13 | 65 | AM/CR | AM | ductile | 167 | Yes |
| $Co_{50}Ni_{22}Nb_4Ta_4V_5B_{15}$ | 50 | 22 | 4 | 5 | 4 | 15 | 72 | 13 | 67 | AM/CR | AM | ductile | 164 | Yes |

AM = completely amorphous
AM/CR = having a crystalline phase

It can be seen that replacement of Fe with Co gives quite remarkable results, as shown in Table 2. A $Co_{50}Ni_{22}Nb_8V_5B_{15}$ strip with a thickness of 65 μm thus displays a very high annealing resistance (time of ductile-brittle transition almost 15 min at 340° C., or 0.8 Tg [K]) and an elastic modulus of 167 GPa. Moreover, this alloy is paramagnetic at room temperature, in contrast to the Fe-based alloys produced up to now.

Forming of the Components

In the course of research, it was found that to make a functional spring, i.e. guaranteeing a certain restoring torque and good reliability during use in a timepiece, the ribbon must preferably be made of an amorphous or substantially amorphous alloy with the required thickness for achieving the functional properties and to be initially ductile in bending. In fact, beyond a certain thickness, the ribbon may display brittle behavior in bending, which would degrade the reliability of the spring.

It is particularly advantageous to use amorphous metal alloys whose mechanical properties are greater than those of the traditional polycrystalline alloys used in the prior art, for example the alloy Nivaflex®. Accordingly, the rest of this account in particular concerns amorphous metal alloys whose elastic limit is above 2400 MPa and/or whose elastic modulus is above 120 GPa, more particularly amorphous metal alloys whose elastic limit is above 2700 MPa and/or whose elastic modulus is above 135 GPa, and preferably amorphous metal alloys whose elastic limit is above 3000 MPa and/or whose elastic modulus is above 150 GPa, i.e., among others, those forming the object of the present invention.

To obtain a high-performance clock or watch spring, such as a barrel spring, the thickness of the ribbon will advantageously be at least 50 μm, as smaller thicknesses do not allow a sufficient restoring torque to be obtained. Moreover, the thickness will advantageously be at most 150 μm.

According to an advantageous embodiment, both a small thickness and an amorphous character are obtained by hyperquenching, or by projecting the molten metal alloy capable of forming the metallic glass onto a cold substrate that is moving, such as a rotating cylinder, optionally a water-cooled rotating cylinder.

Said projection can be achieved for example by employing a method such as "planar flow casting", "melt-spinning" and "twin roll casting".

Preferably, the parameters of projection and of cooling are selected so as to obtain a cooling rate of the molten metal alloy greater than 10 000K/s. Said cooling rate, obtained by hyperquenching, in fact promotes ductility by the formation of "free volume" in the structure of the amorphous metal alloy.

Moreover, it is desirable that projection is carried out so as to obtain a monolithic ribbon having a thickness between 50 and 150 μm, preferably between and 120 μm, and more preferably between 50 and 100 μm. The amorphous metal alloy obtained in these conditions is then clearly different from the bulk metallic glass (BMG), whose thickness is greater than 1 mm.

In the case of the barrel spring, the spring cannot be used directly after casting in the form of a rectilinear ribbon, but must be formed so that it can develop the desired torque, as described in document WO 2010/000081A1. It is therefore necessary to envisage forming the ribbon so that it assumes a given free form, prior to use in a barrel.

It appeared that it is also possible to carry out plastic deformation on a ribbon of amorphous metal alloy, and use it industrially with its plastic deformation, notably in the form of a spring that is repeatedly loaded mechanically in the barrel of a clock or watch movement.

This makes it possible to manufacture functional clock and watch springs in amorphous metal alloy, in particular barrel springs, on an industrial scale.

Regarding the forming of the monolithic ribbon of amorphous metal alloy, plastic deformation can advantageously be carried out at room temperature and under ambient atmosphere. This plastic deformation must not degrade the mechanical properties of the ribbon, so as to permit its repeated mechanical loading, for example in a barrel.

According to an advantageous embodiment of the invention, in addition to the curvature produced by plastic deformation, additional curvature is produced by deforming the ribbon elastically, for example during setting, and by fixing the new shape obtained with a heat treatment at a temperature and for a time not leading to embrittlement of the spring. This additional curvature can in particular be produced on the portions of the ribbon that are not curved by plastic deformation. The heat treatment can be carried out before or after plastic deformation, advantageously before plastic deformation, in particular if the heat treatment affects the zone whose curvature is obtained by plastic deformation.

The appropriate temperature and time of treatment (annealing) are selected in a window of temperature and of time in which the alloy of said metallic glass preserves its ductile behavior in bending. This window thus corresponds in practice to a strain at rupture greater than 2%. These conditions allow the following objectives to be achieved:

i) extend the maximum treatment time before embrittlement, ii) fix the shape, iii) maintain the mechanical properties obtained after ribbon manufacture (hardness and ductility) and iv) avoid crystallization.

As a general rule, an alloy must meet a necessary condition so that forming below Tg, or below Tx for an alloy without a Tg or with Tg>Tx, is to be usable for a spring: superposition of the "fixing" and "ductility" windows. In the cases presented, the time required for fixing the shape is far less than the maximum time corresponding to transition to a brittle state.

The fixing coefficient depends on the thickness of the ribbon but not on the curvature imposed. It is possible to obtain a desired free shape of the barrel spring, for example the theoretical free shape, by using a single fixing coefficient and a copper setting. In a nonlimiting practical example, a slot with a thickness of 0.3 mm was spark-eroded in a copper plate with a thickness of 1.5 mm, with a profile corresponding to the desired free shape of the spring but with radii of curvature contracted by a ratio $D_0/D_f$ to take account of the expansion between the inside diameter of the ring $D_0$ and the diameter of curvature of the relaxed strip $D_f$, while maintaining the length of the various segments of the free shape at 100%.

As an example, a ribbon of metallic glass consisting of the alloy $Co_{50}Ni_{22}Nb_8V_5B_{15}$ of Table 2 was put in the slot of a setting with a ratio $D_0/D_f$=54% by causing it to undergo elastic deformation and the fixing treatment was carried out in a furnace under ambient atmosphere between two ceramic studs thermostatted at 390° C., for 30 s, followed by quenching of the setting. This treatment corresponds to fixing at $D_0/D_f$=54% according to the nomograms obtained by ring fixing. The ribbon, once removed from its setting, has a free shape corresponding almost perfectly to the desired free shape.

According to another embodiment of the method, the spring is not formed in a furnace, but by a jet of hot gas. An apparatus of the "Sylvania Heater SureHeat Jet 074719" type with a power of 8 kW is used for heating compressed air and projecting it onto the setting containing the ribbon. The apparatus can heat a gas (air, or an inert gas such as argon, nitrogen or helium) to 700° C., and the ribbon is inserted in the slot of the copper setting by elastic deformation as previously.

The copper setting is placed perpendicularly opposite the tube for distribution of the hot gas. It could also be held at a certain inclination, for example of 45°. The setting is mounted on a three-position linear guidance system, with which it is possible to i) place the copper setting in a high position, outside the range of the gas jet, ii) position it in the jet of hot gas and iii) quench it immediately in a cooling liquid, such as water for example, at the end of the hot working.

According to a third embodiment of the method, a ribbon of metallic glass consisting of the alloy $Co_{50}Ni_{22}Nb_8V_5B_{15}$ of Table 2 was put in the slot of a setting with a ratio $D_0/D_f$=86% by causing it to undergo elastic deformation and the fixing treatment was carried out between two heating bodies under ambient atmosphere, at 440° C. for 10 s, followed by quenching of the setting. This treatment corresponds to fixing at $D_0/D_f$=86% according to the nomograms obtained by ring fixing. The ribbon, once removed from its setting, has a free shape corresponding almost perfectly to the desired free shape.

According to further embodiments of the method, the setting containing the ribbon is put in a vacuum furnace, or between two ceramic heating plates, these embodiments being given as nonlimiting examples. The forming can also be carried out in two or more steps of heat treatment.

So far we have only examined fixing a desired shape for a ribbon that is initially more or less straight, i.e. without any curvature other than that resulting from manufacture of the ribbon. The given shape can for example correspond precisely to the shape of the negative or positive curvatures of a barrel spring around a point of inflection. In such a case, however, the portions at each end are wound inside circular recesses in the setting made necessary by the limitations due to the thickness of the slot, which has become greater than the space between the spirals of the desired free shape; they cannot therefore follow the theoretical shape on the entire length of the spring.

With a ribbon of a crystalline alloy for springs commonly used, for example Nivaflex®, the desired shape could be obtained by cold plastic deformation. This is notably the case for the inner end of the spring ("tab" or "eye", "tabbing" step). It is in fact necessary to fasten the spring to the arbor of the barrel: as the theoretical curve of the spring gives larger radii of curvature than that of the arbor, it becomes necessary to link the curvature that the spring forms around the arbor to the theoretical curvature by cold deformation of the spring.

However, this step cannot be transferred directly to ribbons made of amorphous metal alloy, as plastic deformation of metallic glasses should in principle be avoided.

It was found, surprisingly, that forming of the ribbon by plastic deformation was possible, for the various alloys tested, without brittle fracture of the ribbon and without adversely affecting the mechanical properties of the formed ribbon. Such a ribbon can then be used as a spring, in particular as a high-performance spring, more particularly as a barrel spring.

This unexpected finding thus makes it possible to provide the desired definitive shapes by cold plastic deformation, before or after optional fixing heat treatment. This forming by plastic deformation can be limited to the tab (inner end), but can also be carried out on a more extensive portion of the spring, or even on the whole shape given to the spring.

Note at this point that the cutout at the inner end of the spring (for hooking it to the nib of the core of the barrel arbor) is cut out by conventional stamping. Other methods of attaching the spring to the arbor of the barrel can of course be used, for example welding.

A sliding flange intended to be fixed to the outer end of the spring is made either of "Nivaflex®" alloy, or in a strip of the same alloy as that of the ribbon, obtained by the same technique of "planar flow casting" and formed by cold plastic deformation (see below) in order to give it the typical curvature of a sliding flange for a barrel spring with automatic reassembly. It can be assembled by resistance (spot) welding as usual, by laser welding, by riveting, etc.

The inventors therefore wanted to know whether the method of obtaining the curvature of the tab by plastic deformation was applicable to the whole spring.

The technique of tabbing consists of deforming the plate by hammering. The curvature is controlled by two parameters: the amount of movement of the ribbon between two hammer blows and the amplitude of the deformation, controlled by the angle of rotation of the hammer about its axis. It is necessary to adapt the parameters in relation to the alloy and the thickness of the ribbon.

Forming by cold plastic deformation is carried out in two stages: firstly, the outer end of the ribbon is introduced in order to apply a negative curvature according to the theoretical curvature desired up to the point of inflection. Then the inner end is introduced in order to apply a positive curvature according to the theoretical curvature.

As we have seen from the above description, it is possible to impart a curvature to a ribbon of amorphous metal alloy at temperatures well below Tg, or well below Tx for an alloy not displaying a Tg or with Tg>Tx. The "fixing coefficient", i.e. the ratio of the required curvature to the curvature obtained after heat treatment, depends on the thickness of the ribbon but does not depend on the required curvature, thus making it possible to form a barrel spring with variable curvature. This coefficient also depends on the forming means used (furnace, gas jet, etc.) and on the characteristics of the equipment, as the temperature to which the ribbon is submitted directly is difficult to measure precisely.

Moreover, the annealing for fixing must not make the ribbon brittle and it must therefore be effected at a temperature and for a time below the embrittlement point. In our experience, most of the amorphous alloys presented in Tables 1 and 2 show sufficient resistance to embrittlement on annealing for hot forming to be applied to them (indicated in the column "annealing resistance").

The foregoing implies that for an alloy possessing a good forming window, several treatments can lead to the same degree of fixing of the shape. It is thus possible to select the conditions of treatment so as to maximize the performance of the spring, or even add the treatments together or combine them with one or more cold or hot plastic deformations.

Finally, it is possible to fix the shape of ribbons of various alloys, by plastically deforming the spring near the inner end, or on several zones, or even on its entire length, if necessary supplementing the forming operation with a heat treatment in an annealing window at a temperature below Tg and/or below Tx, with an industrially applicable treatment time. The ribbons remain ductile, do not lose their mechanical strength and preserve their amorphous or essentially amorphous character. This method makes it possible to obtain, among other things, functional barrel springs with excellent characteristics.

The method described above can also be applied to the forming of springs other than the barrel spring, whether it is for components of a clock or watch movement (jumper spring, or sliding flange for barrel spring, for example) or of clock-making external parts, case, or bracelet.

To summarize, a method can be used for making a spring for a timepiece having at least one monolithic ribbon made of a substantially amorphous metal alloy, which corresponds to the aforementioned formula $Fe_aCo_bNi_cNb_dV_eB_fTa_g$ and comprising at least one curvature, said method having the characteristic features defined in the following point 1:

1. —it comprises a step of forming said monolithic ribbon by plastic deformation in order to obtain at least one portion of said curvature.

Other optional but advantageous features of this method are presented in the following points, which can be combined or linked together:

2. —the step of forming the monolithic ribbon by plastic deformation is preceded by a step of obtaining said ribbon, which comprises projection of a molten metal alloy that is able to form a substantially amorphous metal alloy onto a cooled, moving substrate;

3. —the monolithic ribbon of metallic glass is obtained by hyperquenching according to one of the methods called "planar flow casting", "melt-spinning", and "twin roll casting", 4. —the alloy is projected so as to obtain a cooling rate of the molten metal alloy greater than 10 000K/s, 5. —the alloy is projected so as to obtain a monolithic ribbon having a thickness between 50 and 150 μm, 6. —the step of forming by plastic deformation is preceded or followed by a step of fixing of at least a portion of the monolithic ribbon, 7. —the step of forming by plastic deformation is preceded or followed by a step of fixing of said portion of the curvature by heat treatment of at least this portion of the curvature, 8. —the fixing step is carried out by elastic deformation of said ribbon in a setting followed by fixing of the shape by said heat treatment, 9. —the heat treatment is carried out at a temperature and for a time making it possible to preserve the ductility of substantially amorphous metal, and therefore a strain at rupture greater than 2%, 10. —the temperature of the heat treatment is 50° C. lower than the glass transition temperature Tg of said amorphous metal alloy or than the temperature of crystallization Tx for an alloy not displaying a Tg or in which Tg>Tx, 11. —the temperature of the heat treatment is 100° C. lower than the glass transition temperature Tg of said amorphous metal alloy or than the temperature of crystallization Tx for an alloy not displaying a Tg or in which Tg>Tx, 12. —the setting used for forming the spring comprises the profile of the spring roughly corresponding to the desired free shape for the spring with contracted radii of curvature as a function of the fixing coefficient depending on the thickness and on the alloy of said ribbon and the temperature and time selected for fixing, the length of the segments of said profile corresponding to the true length of said free shape, 13. —the fixing coefficient is between 50% and 90%, preferably between 85 and 90%, 14. —the plastic deformation is carried out at room temperature, 15. —a substantially amorphous metal is used, having an elastic limit above 2400 MPa and/or an elastic modulus above 120 GPa, 16. —a substantially amorphous metal is used, having an elastic limit above 3000 MPa and/or an elastic modulus above 150 GPa, 17. —the spring is a barrel spring and the plastic deformation is applied at least to its inner portion, 18. —the whole spring is formed by plastic deformation, 19. —the spring is a barrel spring comprising curvatures that are positive, or negative, on either side of a point of inflection.

Use as a Spring

According to the invention, the excellent mechanical properties of the amorphous metal alloys are utilized in the watchmaking and clock-making components according to the invention, for example in the form of springs, notably barrel springs. For making barrel springs, ribbons were formed by one or other of the methods described above or in international patent applications WO2010/000081 and WO2011/069273. Table 3 gives an example of the characteristics of a barrel spring made of alloy $Co_{50}Ni_{22}Nb_8V_5B_{15}$ by the method described below.

A heat treatment for forming was carried out on a ribbon of substantially amorphous alloy of composition $Co_{50}Ni_{22}Nb_8V_5B_{15}$ with a thickness of 62 μm at an annealing temperature of 440° C. for a treatment time of 10 s, corresponding to a fixing coefficient $D_0/D_f$ of 86%, in a setting equipped with a circular recess for the outer portion of the spring and a rectilinear portion for the inner portion. One portion of the ribbon was formed by cold plastic deformation, notably the tab, by hammering, and the portion around the point of inflection by winding the mainspring.

Table 3 summarizes the properties obtained with this spring, as well as with a spring made with an amorphous alloy $Ni_{53}Nb_{20}Zr_8Ti_{10}Co_6Cu_3$ and a conventional "Nivaflex®" alloy. The dimensions of the barrel (radius of the arbor and of the drum, height) are identical for the three types of spring. It can be seen that the torque values obtained with the Co-based alloy are comparable to those obtained with the Nivaflex® alloy. The decrease in torque during unwinding is less pronounced for the Co alloy (among other things, smaller decrease in torque between 0.5 turns of unwinding and 24 h of unwinding). Moreover, the main parameter of the barrel, i.e.

the autonomy, is improved by nearly 20% by using an amorphous Co-based alloy for an identical volume occupied by the spring, which is considerable. Finally, the fatigue behavior of the barrel springs made of amorphous alloys is equivalent in comparison with conventional alloys such as Nivaflex®.

TABLE 3

| Alloy | Nivaflex ® | $Ni_{53}Nb_{20}Zr_8Ti_{10}Co_6Cu_3$ | $Co_{50}Ni_{22}Nb_8V_5B_{15}$ |
|---|---|---|---|
| Torque 0.5 t [mNm] | 3.8 | 2.9 | 3.8 |
| Torque 24 h [mNm] | 3.2 | 2.3 | 3.5 |
| Autonomy [h] | 49 | 43.5 | 58 |
| Losses at 24 h [%] | 15.2 | 21.2 | 10.0 |

Barrel springs were also produced solely by forming by cold plastic deformation, as described above and in international patent application WO2011/069273. The characteristics obtained are also satisfactory and the barrel springs are perfectly functional.

The invention claimed is:

1. A watch-making or clock-making component comprising an amorphous metal alloy corresponding to the formula $$Fe_aCo_bNi_cNb_dV_eB_fTa_g$$

in which:
$0 \le a \le 70$;
$0 \le b \le 70$;
$8 < c \le 60$;
$1 \le d \le 19$;
$1 \le e \le 10$;
$12 < f \le 25$;
$0 \le g \le 5$;
with
$20 \le a+b \le 70$;
$50 \le a+b+c \le 86$;
$8 \le d+e \le 20$; and
$a+b+c+d+e+f+g=100$.

2. The watch-making or clock-making component as claimed in claim 1, in which, in the alloy:
$0 \le a \le 60$;
$0 \le b \le 60$;
$10 \le c \le 50$;
$2 \le d \le 17$;
$2 \le e \le 8$;
$14 \le f \le 20$;
$0 \le g \le 4$;
with
$25 \le a+b \le 65$;
$60 \le a+b+c \le 80$; and
$8 \le d+e \le 17$.

3. The watch-making or clock-making component as claimed in claim 2, in which, in the alloy:
$0 \le a \le 56$;
$0 \le b \le 54$;
$12 \le c \le 40$;
$4 \le d \le 14$;
$4 \le e \le 6$;
$15 \le f \le 17$;
$0 \le g \le 4$;
with
$30 \le a+b \le 60$;
$68 \le a+b+c \le 75$; and
$11 \le d+e \le 15$.

4. The watch-making or clock-making component as claimed in claim 3, in which the alloy is selected from the following alloys:
$Co_{50}Ni_{18}Nb_{12}V_5B_{15}$;
$Co_{54}Ni_{14}Nb_{12}V_5B_{15}$;
$Co_{32}Ni_{40}Nb_8V_5B_{15}$;
$Co_{40}Ni_{32}Nb_8V_5B_{15}$;
$Co_{42}Ni_{30}Nb_8V_5B_{15}$;
$Co_{50}Ni_{22}Nb_8V_5B_{15}$; and
$Co_{50}Ni_{22}Nb_4Ta_4V_5B_{15}$.

5. The watch-making or clock-making component as claimed in claim 4, in which the alloy is selected from the following alloys:
$Co_{32}Ni_{40}Nb_8V_5B_{15}$;
$Co_{40}Ni_{32}Nb_8V_5B_{15}$;
$Co_{42}Ni_{30}Nb_8V_5B_{15}$;
$Co_{50}Ni_{22}Nb_8V_5B_{15}$; and
$Co_{50}Ni_{22}Nb_4Ta_4V_5B_{15}$.

6. The watch-making or clock-making component as claimed in claim 1, in which, in the alloy, $g=0$.

7. The watch-making or clock-making component as claimed in claim 1, in which, in the alloy, $a=0$.

8. The watch-making or clock-making component as claimed in claim 7, in which, in the alloy:
$31 \le b \le 56$;
$13 \le c \le 41$;
$7 \le d \le 13$;
$4 \le e \le 10$; and
$13 \le f \le 17$.

9. The watch-making or clock-making component as claimed in claim 1, in which, in the alloy, $b=0$.

10. The watch-making or clock-making component as claimed in claim 1, in which, in the alloy:
$47 \le a \le 57$;
$17 \le c \le 23$;
$3 \le d \le 9$;
$4 \le e \le 10$;
$13 \le f \le 17$; and
$g=0$.

11. The watch-making or clock-making component as claimed in claim 1, in which the alloy is selected from the following alloys:
$Fe_{50}Ni_{22}Nb_8V_5B_{15}$;
$Fe_{52}Ni_{20.66}Nb_{7.33}V_5B_{15}$;
$Fe_{56}Ni_{18}Nb_6V_5B_{15}$;
$Fe_{54}Ni_{20}Nb_6V_5B_{15}$;
$Fe_{52}Ni_{22}Nb_6V_5B_{15}$;
$Fe_{48}Ni_{22}Nb_6V_9B_{15}$;
$Fe_{52}Ni_{22}Nb_4V_7B_{15}$;
$Fe_{50}Ni_{22}Nb_6V_7B_{15}$;
$Fe_{30}Co_{20}Ni_{22}Nb_8V_5B_{15}$; and
$Fe_{36}Co_{24}Ni_{12}Nb_8V_5B_{15}$.

12. The watch-making or clock-making component as claimed in claim 11, in which the alloy is selected from the following alloys:
$Fe_{56}Ni_{18}Nb_6V_5B_{15}$;
$Fe_{52}Ni_{22}Nb_6V_5B_{15}$;
$Fe_{54}Ni_{20}Nb_6V_5B_{15}$;
$Fe_{50}Ni_{22}Nb_6V_7B_{15}$;
$Fe_{30}Co_{20}Ni_{22}Nb_8V_5B_{15}$; and
$Fe_{36}Co_{24}Ni_{12}Nb_8V_5B_{15}$.

13. The watch-making or clock-making component as claimed in claim 12, in which the alloy is selected from the alloys $Fe_{30}Co_{20}Ni_{22}Nb_8V_5B_{15}$ and $Fe_{36}Co_{24}Ni_{12}Nb_8V_5B_{15}$.

14. The watch-making or clock-making component as claimed in claim 1, said component being a spring.

15. The watch-making or clock-making component as claimed in claim 14, said component being a barrel spring.

16. A method of preparing a watch-making or clock-making component as claimed in claim 1, in which, under an inert atmosphere:

a) pre-melting of the pure metallic elements Fe and/or Co, Ni, Nb and V is carried out in a container;

b) boron is heated, so as to degas it;

c) the pre-melted metallic elements and the boron in solid form are mixed;

d) the mixture obtained is heated;

e) the mixture is cooled;

f) optionally steps d) and e) are repeated one or more times, the last step e) being a hyperquench;

g) the alloy obtained is formed to the desired shape so as to obtain the watch-making or clock-making component of claim 1.

17. The method as claimed in claim 16, in which step c) is divided into substeps of formation of partial mixtures so as to form pre-alloys whose melting point is below that of their individual constituents.

18. The method as claimed in claim 16, in which, in step g), the amorphous metal alloy is cast in the form of ribbon or wire.

19. The method as claimed in claim 18, in which hyperquenching and casting in the form of ribbon or wire are performed simultaneously.

20. The method as claimed in claim 19, in which hyperquenching and casting are carried out by planar flow casting.

21. The method as claimed in claim 16, in which Ta is added in step a).

22. The method as claimed in claim 21, wherein Ta is pre-melted in step a).

* * * * *